United States Patent [19]

Knieser

[11] 4,072,307

[45] Feb. 7, 1978

[54] CORNER SHEET STRIPPER

[75] Inventor: James J. Knieser, Webster, N.Y.

[73] Assignee: Xerox Corporation, Stamford, Conn.

[21] Appl. No.: 781,892

[22] Filed: Mar. 25, 1977

[51] Int. Cl.[2] ..... B65H 29/56

[52] U.S. Cl. ..... 271/174; 271/DIG. 2; 355/3 R

[58] Field of Search ..... 271/DIG. 2, 174, 80; 118/245, 60; 34/120; 100/174; 355/3 R; 432/60

[56] References Cited

U.S. PATENT DOCUMENTS

| | | | |
|---|---|---|---|
| 3,912,256 | 10/1975 | Nagahara | 271/DIG. 2 |
| 3,953,121 | 4/1976 | Reichart | 118/658 X |
| 3,955,889 | 5/1976 | Ishiguro et al. | 271/DIG. 2 |

FOREIGN PATENT DOCUMENTS

| | | | |
|---|---|---|---|
| 4,987,337 | 8/1974 | Japan | 271/DIG. 2 |

*Primary Examiner*—Bruce H. Stoner, Jr.

[57] ABSTRACT

A sheet stripper for mechanically stripping copy sheets from the moving imaging surface of an edge registration type copier without contacting the actual imaging area of the imaging surface. The stripper has a bearing portion continuously riding only on an edge area of the imaging surface outside of the imaging area. An integral stripping finger is rigidly cantilevered from this bearing portion out over the imaging area into the path of one corner of the lead edge of copy sheets thereon. The stripping edge of this stripping finger is continuously maintained spaced above the imaging area, by less than the thickness of a single sheet, by the adjacent integral bearing portion riding on the closely adjacent area of the imaging surface.

13 Claims, 3 Drawing Figures

CORNER SHEET STRIPPER

SUMMARY AND BACKGROUND OF THE INVENTION

The present invention relates to an improvement in copying apparatus for the removal of the final image support surface from the initial image support surface after the transfer of the image.

In a transfer electrostatographic process such as conventional transfer xerography, in which an image pattern of dry particulate unfused toner material is electrostatically transferred to a final image support surface (the copy sheet) from an initial image support surface (the charged photoreceptor surface developed with toner), the transferred toner is typically only loosely adhered to the final support surface and is easily disturbed by the subsequent necessary process of stripping the final support surface away from the initial support surface unless such stripping is carefully controlled. In the transfer station the copy sheet must be maintained at all times in accurate registration with the toner image to be transferred, and not shifted relative to the imaging surface as it is stripped, or the unfused toner image may be smeared. The photosensitive imaging surface is typically easily scratched or abraded sufficiently to produce visible copy defects by direct contact of a mechanical stripping element therewith. The copy sheets themselves are thin, relatively delicate and may be highly variable in condition, humidity, material, weight, etc.. Further, the stripping of the copy sheet from the photosensitive surface is resisted by the electrostatic attraction between any transfer charge remaining on the copy sheet and the photoreceptor. Stripping can also be resisted or made more difficult by pre-existing curls in the lead edge of the copy sheet. Thus, it may be seen that the stripping system of an electrostatographic copying system has difficult challenges to overcome these obstacles of electrical transfer charge tacking of the copy sheet to the photoreceptor, etc., with severe limitations on the type of sheet stripping mechanism which can be utilized without damaging the initial imaging surface or disturbing the toner image before or after transfer.

The drum or belt on which the initial imaging surface moves inherently fluctuates or shifts in position at the stripping area during operation, perpendicularly to its desired movement direction, due to mechanical tolerances in the imaging surface and its supports, and bearings. This eccentricity in the rotation of a cylindrical drum photoreceptor is known as run-out. These imaging surface position fluctuations typically exceed the thickness of the copy sheet thereon. Thus, a fixed or rigid stripping system relying on mechanically catching a sheet with a fixed position stripping edge would not be practical in a conventional copier. Thus, an effective mechanical stripping system requires some means for sensing and following such imaging surface fluctuations.

In xerography, the toner image transfer is most commonly achieved by electrostatic force fields created by D.C. charges applied to or adjacent the back of the copy sheet while the front side of the copy sheet contacts the toner bearing photoreceptor surface. These transfer fields must be sufficient to overcome the forces holding the toner onto the photoreceptor and to attract a substantial portion of the toner onto the copy sheet. The transfer fields are generally provided in one or two well known ways; by ion emission of D.C. charges, from a transfer corona generator, deposited onto the back of the copy paper, or by a D.C. biased transfer roller or belt rolling along the back of the paper, and holding it against the photoreceptor. In either case the copy sheet must be held in registration with, and moved together with, the imaging surface in order to transfer a registered and unsmeared image. Particularly in the conventional transfer accomplished by D.C. corona charges applied to the back of the copy sheet, these transfer charges also provide a substantial "tacking" force which electrostatically holds the copy sheet down against the imaging surface for the movement of the copy sheet therewith.

Thus, a particularly difficult problem in modern xerographic transfer systems is the reliable and consistent stripping of the copy sheet off of the imaging surface after the transfer of the image has been accomplished. Due to practical space and time constraints, this must generally be done as closely as possible after the transfer step, yet without disturbing the transferred toner image on the copy sheet.

Various stripping systems have been utilized in the prior art. One such system is an air puffer applying a jet of air towards the lead edge of the copy sheet to initiate its separation from the imaging surface, as described in U.S. Pat. No. 3,062,536, issued Nov. 6, 1962, to J. Rutkus, Jr., et al.. Another is a vacuum stripping system as shown, for example, in U.S. Pat. No. 3,885,785, issued May 27, 1975, to R. A. Burkett, et al..

Various mechanical stripping systems are known using stripping fingers for catching the lead edge of the copy sheet and stripping the sheet from the photoreceptor. An example of an effective commercial mechanical stripping finger system is disclosed in U.S. Pat. No. 3,578,859, issued May 18, 1971, to W. K. Stillings.

The present invention relates to such mechanical or direct sheet contact sheet stripping, with improved protection for the photoreceptor imaging surface, yet without requiring large, complex, or expensive mechanical, electrical or pneumatic systems.

Another type of stripping system, which desirably may be used in cooperation with the present system, is a self-stripping system utilizing a detacking corotron, taught in U.S. Pat. No. 3,870,515, issued Mar. 11, 1975, to Norbett H. Kaupp. This system utilizes the self-straightening tendency of the copy sheet to continue along a linear path when the imaging surface curves away from this path at a stripping area in combination with a detacking corotron to remove most of the tacking charge. However, it is not necessarily desirable to remove all of the transfer charge on the copy sheet to aid in stripping, since that may also reduce the electrostatic retention of the toner image to the copy sheet.

The Stillings patent cited above also discloses a vacuum manifold sheet guide system closely adjacent the photoreceptor and forming a part of the stripping system after stripping of the lead edge has been initiated. That is, once a lead edge area of the sheet has been initially stripped, it may be captured by a downstream sheet transport and the remainder or body of the sheet can be removed by that transport. Such subsequent sheet transport systems may also be desirably utilized with the present invention.

The mechanical stripper of the invention may be used as the sole and continuously maintained primary stripping system for a copier, or as a downstream "back-up" stripper system to catch mis-strips from another type of stripping system such as a vacuum stripper, upstream therefrom. Such mis-strips may occur with sheets whose particular weight, humidity, curl, or other condition renders them particularly difficult to strip from the imaging surface by the primary stripping system.

STATEMENT OF PRIOR ART

In prior art mechanical stripping systems, it is known to position a mechanical stripping finger with a bearing surface in sliding, drum riding direct engagement with the imaging surface, thereby holding a sharp leading stripping edge thereof against, or slightly raised above, the imaging surface, riding close enough to catch the lead edge of a copy sheet on the imaging surface as it emerges from the transfer area and thereby initiate stripping of the copy sheet away from the imaging surface. Examples of art in this area include the above-cited U.S. Pat. No. 3,578,859, issued May 18, 1971, to W. K. Stillings, U.S. Pat. No. 3,450,402, issued June 17, 1969, to E. A. H. Weiler, U.S. Pat. No. 3,992,000, issued Nov. 16, 1976, to H. G. Martin, U.S. Pat. No. 3,948,507, issued Apr. 6, 1976, to K. K. Strange, and U.S. Pat. No. 3,885,786, issued May 27, 1975, to H. F. Schmalzbauer. In the systems of these patents, however, since the stripper fingers are biased directly against the imaging area of the imaging surface they can cause wear or scratches therein under certain conditions.

It is also known to initiate stripping by a stripping claw or finger engaging one corner of the lead edge of the copy sheet. The Weiler U.S. Pat. No. 3,450,402 cited above teaches, at Col. 4, lines 25–30, that stripping of a copy sheet may be initiated at a corner thereof by a stripper finger at one side of the imaging surface in the path of that corner of the sheet. As also shown there, further supplemental stripping fingers may be utilized in cooperation with an initial corner stripping finger to continue the stripping of the rest of the copy sheet lead edge. Corner edge stripping is also shown in Japanese application No. 48-604, filed Dec. 23, 1972, by Toru Takahashi (Canon, Inc.) laid open Aug. 21, 1974, as laid open number 49-87337. However, here also, the stripping element is undesirably in pressure contact with the photoreceptor within an area of the photoreceptor utilized for image formation. An example of corner stripping using a belt is in U.S. Pat. No. 4,000,942, issued Jan. 4, 1977, to Y. Ito, et al.. This causes loss of image in the belt area. The present invention, in contrast, utilizes corner-first stripping, but never contacts the imaging surface in the area thereof utilized for imaging.

To reduce such wear or damage to the imaging surface such mechanical stripping finger systems generally employ solenoid or other mechanisms controlled by timing systems to only intermediately pivot the stripper fingers into a stripping position on the photoreceptor only when (and each time) a copy sheet approaches. This adds additional complexities, cost, and maintenance. These are all avoided by the present stripping system, which may be continuously left in its stripping position, since it never engages the imaging area of the imaging surface.

Photoreceptor non-image edge area bearing supports such as in the developer unit of U.S. Pat. No. 3,953,121, issued Apr. 27, 1976, to L. W. Reichert, Jr., are known for run-out compensation for other copier components. However, these are less critical applications involving much less critical spacings. They teach the equivalency of rollers or sliding bearings whereas rollers would in general have unacceptable tolerances for the present system. Further, they require the bearings at both sides (ends) of the photoreceptor, which could not work with the present system.

It is also known to provide a mechanical stripping system in which the stripping finger edge is maintained out of contact with the imaging surface by pneumatic flotation. This is shown in U.S. Pat. No. 3,837,640, issued Sept. 24, 1974, to J. R. Norton, et al., and U.S. Pat. No. 3,804,401, issued Apr. 16, 1974, to K. Stange. A stripper finger automatically spaced by a pneumatic servo-control bellows system is disclosed in U.S. Pat. No. 3,891,206, issued June 24, 1975, to A. Bar-On.

These systems have the obvious disadvantages of the required pneumatic supplies and controls. In contrast, the present stripping system is particularly suitable for a low cost, low speed, low power consumption, copier. It automatically maintains the required critical spacing without requiring any pneumatic or electrical controls, with a simple purely mechanical system. Yet the present system provides a positive and constant self-spacing of the stripper finger less than half a sheet thickness above the photoreceptor regardless of photoreceptor drum run-out or other fluctuations or movements in the position of the imaging surface.

BRIEF DESCRIPTION OF THE DRAWINGS

Further objects, features and advantages of the present invention pertain to the particular apparatus and steps whereby the above-mentioned aspects of the invention are obtained. Accordingly, the invention will be better understood by reference to the following description and to the drawings forming a part thereof, which are approximately to scale except for the paper thickness and photoreceptor clearances noted here which have been exaggerated for drawing clarity, wherein.

DETAILED DESCRIPTION OF A PREFERRED EMBODIMENT

Figure 1:
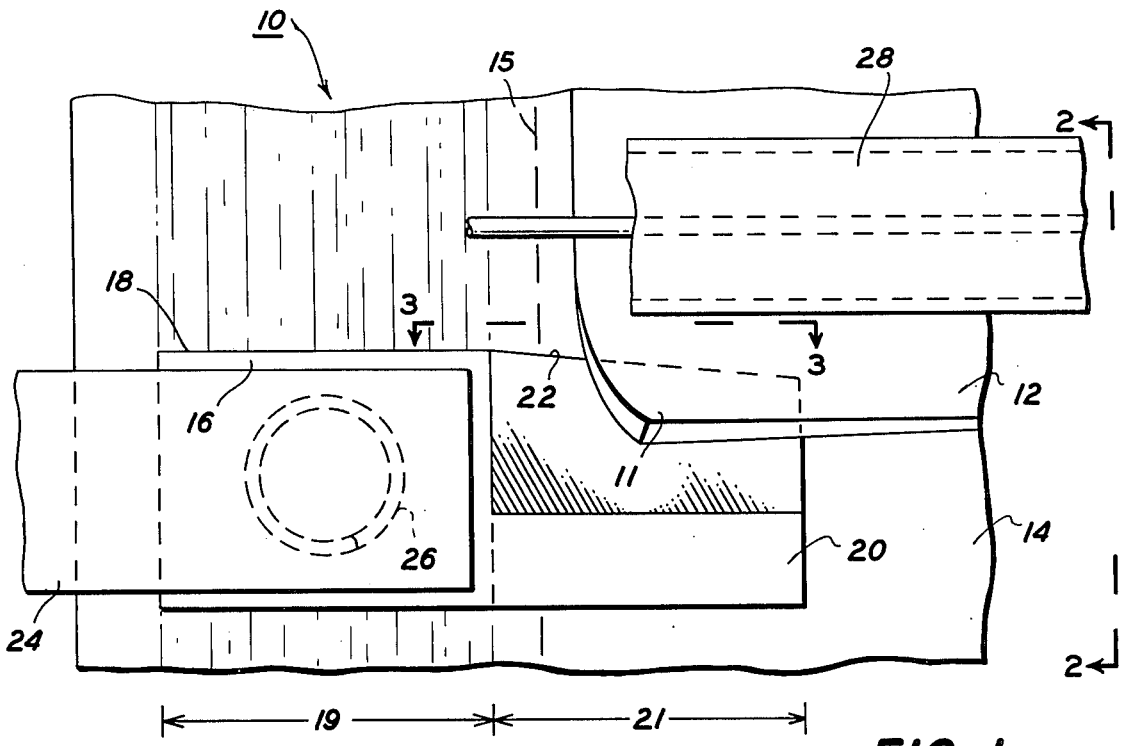
FIG. 1 is a bottom view of an exemplary mechanical copy sheet stripping system in accordance with the present invention, shown with the related portions of a conventional xerographic copying apparatus.
Figure 2:
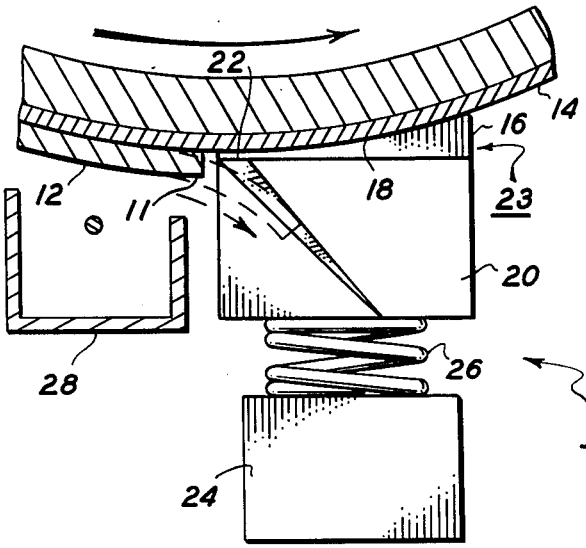
FIG. 2 is an end view of the embodiment of FIG. 1 taken in the direction 2—2 in FIG. 1.
Figure 3:
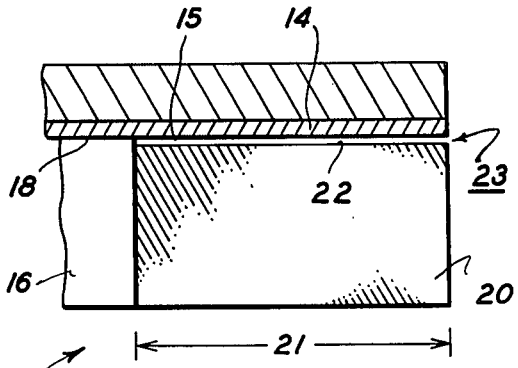
FIG. 3 is a side view of the embodiment of FIGS. 1 and 2 taken in the direction 3—3 in FIG. 1.

FIGS. 1 through 3 illustrate one example of the present invention. It will be appreciated that the subject mechanical sheet stripper may have other different orientations and structures, and different combinations with different exemplary xerographic or other copying systems. The exemplary stripping system 10 is shown as a part of an electrostatographic copier in which the copy sheets are electrostatically adhered to an imaging surface, and which imaging surface is readily damaged by abrasion or scratches from a member contacting that surface, such as a selenium alloy coated cylindrical drum.

As shown in FIGS. 1 and 2, a lead edge corner 11 of a copy sheet 12 is being stripped from a photoreceptor 14 by the stripper system 10. As noted above, once one corner of the lead edge of the copy sheet has been stripped away from the photoreceptor, other additional or supplemental stripping means and transport means may be utilized to assist or guide the continued stripping of the remainder of the copy sheet as the copy sheet continues its movement forward, in the direction shown by the arrows in FIGS. 1 and 2. The copy sheet 12 is moving in the same direction and velocity of normal movement as the surface of the photoreceptor 14 to which it is electrostatically adhered, and from which it has received a transferred toner image.

The image is formed and transferred on the photoreceptor 14 only within the imaging area thereof. The copy sheet 12 is placed on the photoreceptor 14, directly overlying the image thereon. Thus, the copy sheet 12 also only lies within the imaging area of the photoreceptor 14. The limit or boundary, along one edge, of the imaging area is indicated here by the dashed line 15 shown in FIG. 1. The imaging area is to the right of this line 15. To the left of this is a defined nonimaging edge area of the photoreceptor 14. This edge area is never utilized for imaging, but is at substantially the same position at all times as the adjacent imaging area surface of which it is a continuation. That is, any perturbations, such as drum run-out, etc., in the position of the photoreceptor surface perpendicular the normal direction of movement of the photoreceptor 14 are effectively equal in both the imaging area of the photoreceptor surface, and the immediate non-imaging edge area thereof.

The stripping system 10 here preferably is a single integral, monolithic, member. It is preferably formed into the desired component sub-systems by machining or grinding or otherwise accurately forming the desired configurations from a solid block of metal, or hard and/or reinforced plastic.

The stripping member 10 has an integral bearing portion 16 having a bearing surface 18 thereon adapted to smoothly slidably ride on the surface of the photoreceptor 14, in the non-imaging area thereof, i.e., only to the left of the limit 15 of the imaging area in FIG. 1. This bearing surface 18 provides the sole bearing support for the entire stripping member, and is the only portion thereof ever in contact with any portion of the photoreceptor 14. Since the bearing surface 18 only engages the photoreceptor edge area, outside of the imaging area, it may remain in contact therewith continuously, since any scratches or abrasions placed on the photoreceptor in that edge area will never effect the imaging and, therefore, never effect the copies. Some exaggerated scratches or wear marks are shown in this bearing area of the photoreceptor in FIG. 1. The bearing surface 18 may, if desired, have a Teflon coating or integral pad or other suitable low friction surface material.

It will be appreciated that the particular copying system here is an edge registration system in which, regardless of the size of the image or the size of the copy sheet, the image and the copy sheet are always registered with one edge directly adjacent the same position on the same side of the photoreceptor. That is, as shown in FIG. 1, the edge of the copy sheet 12 is directly adjacent the limit 15 of the imaging area for all copy sheets. Thus, the lead edge corner 11 of the copy sheet 12 will always approach the stripping system 10 at the same position, and pass closely adjacent the bearing portion 16 thereof.

As shown in FIG. 1, the bearing portion 16, and its coextensive bearing surface 18, extend for a substantial distance transverse the direction of normal movement of the photoreceptor 14. This dimension is indicated by the reference number 19 there. The bearing surface 18 underlies a major portion of the dimensions of the entire stripping member 10 transverse the normal direction of movement of the photoreceptor 14. Further, as shown in FIG. 2, the bearing surface 18 is machined or otherwise formed to correspond to the curvature of the photoreceptor 14 at its area of engagement therewith and also extends for a substantial distance in the direction of movement of the photoreceptor. Thus, a large bearing surface area is provided to stably support the entire stripping system 10 on the photoreceptor 14, preventing any relative movement between any part of the stripping system 10 and the photoreceptor 14.

The stripper 10 further includes a finger portion 20 integral the bearing portion 16, but extending from the bearing portion 16 out into (overlying) the imaging area of the photoreceptor as shown in FIGS. 1 through 3. This stripping finger portion of the stripper is a thick, rigidly cantilevered integral extension of the bearing portion of the stripper continuously spaced above the photoreceptor surface.

As may be particularly seen in FIG. 3, the entire stripping finger portion 20 is continuously held out of contact with the photoreceptor 14 by a continuous, but very small, clearance 23, (also shown in FIG. 2). The entire forward (upstream or copy sheet facing) side of the finger portion 20 is a wedge shaped blade terminating sharply at its extreme upstream edge, which is adjacent the photoreceptor surface. This is the sheet stripping edge 22. The stripping edge 22 is adapted, as in the above-cited references, to strike and strip the oncoming lead edge of the copy sheet 11.

It may be seen that the stripping edge 22 of the stripping finger portion 20 extends continuously from the edge area (at line 15) of the imaging surface out to the furthermost end of the entire stripping finger portion 20, i.e., the furthermost portion of the stripping finger extending it to the imaging area. This dimension 21 is shown in FIG. 1. Thus, the entire finger portion 20 provides a stripping edge 22 and also provides a ramp surface behind that stripping edge for lifting the edge of the copy sheet away from the photoreceptor.

The dimension 19 by which the bearing surface 18 extends transversely of the direction of normal movement of the imaging surface is greater than the distance 21 by which the stripping finger portion 20 extends unsupported from said bearing surface 18. This provides a high level of stability for the stripper finger 20 and prevents any stresses on any portion of the stripper finger due to its contact with the copy sheet from causing any deflection or movement of the stripping system. In particular, it resists any significant change in the clearance 23.

As an additional, optional, feature, which is desirably provided here, the finger portion 20, including the stripping edge 22 is somewhat angularly disposed to the normal direction of movement of the imaging surface, as shown particularly in FIG. 1. This is to provide a stripping edge 22 angled relative to the lead edge of the copy sheet 12 approaching it. With this downstream angle, the lead edge corner 11 of the copy sheet will always contact the stripping edge 22 first, before the remainder of the lead edge of the copy sheet contacts the stripping edge. This provides a desired "peeling" action of the corner 11 of the copy sheet 12 away from the photoreceptor, beginning with the actual corner thereof, as shown in FIG. 1.

The uniform spacing 23 of the stripping edge 22 above the photoreceptor surface is extremely critical to provide effective stripping. It must be spaced from the photoreceptor by less than the thickness of the thinnest copy sheet to be stripped. For effective stripping it should be sufficiently closely spaced from the photoreceptor to catch the lead edge of the sheet more than half-way below its maximum thickness, i.e., closer than the mid-point between the photoreceptor surface and the outer surface of the copy sheet. Thus, for effective stripping a continuously maintained approximately 0.0005 inch spacing 23 (0.0127 millimeters) is desirable. A spacing of greater than 0.0008 inches (0.02 millimeters) would not provide sufficiently reliable stripping for ordinary copy paper such as 20 pound bond paper which is typically 0.003 to 0.0035 inches thick. For thinner (lighter) copy paper the maximum allowable clearance is even smaller. Further, it will be appreciated that the stripping clearance is even smaller. Further, it will be appreciated that the stripping clearance may diminish somewhat with wear on the bearing surface 18 or on the area of the drum on which it rides. Preferably this critical spacing 23 is formed by machining or grinding away the surface of the stripping member facing the photoreceptor over the entire finger portion 20.

While the bearing surface 18 here is a single surface, it will be appreciated that it may be provided by two or more discrete spaced bearing areas substantially transversely spaced relative to the direction of the movement of the imaging surface, to provide a bearing surface of sustantially the same stability. Thus, the term bearing surface as used herein is intended to encompass multiple discrete areas providing a common bearing surface. Spaced discrete drum riding shoes or bearing surfaces for a stripper element are shown in the above-cited U.S. Pat. No. 3,992,000, issued Nov. 16, 1976, to H. G. Martin. Also described there is the grinding away of a portion of a bearing area to provide clearance for the actual stripping edge.

It will be appreciated that such a critical spacing can only be effectively provided by a stripping system capable of following the movement or variations in the surface position of the photoreceptor 14, since it would be extremely difficult to hold the drum run-out or other manufacturing tolerances to such critical dimensions, particularly in a low cost commercial copying machine.

There is disclosed, particularly in FIG. 2, an exemplary mounting system to allow this drum riding or following movement of the stripping system 10 with the variations in the position of the surface of the photoreceptor 14 at the stripping area. There is shown here a spring 26 under tension between the bearing portion 16 and a mounting bracket 24 fixed to the frame of the copier unit. The spring 26 here is sufficiently stiff and wide to resist torsion or other movement by the stripping system 10, along with the shape of the bearing surface 18. That is, only movement of the stripper 10 toward and away from the photoreceptor 14 is allowed.

FIGS. 1 and 2 further disclose a detack corona generator 28 functioning as described in the above-cited U.S. Pat. No. 3,870,515. The upstream positioned detack corotron 28 functions as described therein to reduce the previously applied transfer charges on the copy sheet and thereby assist in the stripping. This detacking or neutralizing charge may, if desired, be pulsed so as to be applied only to the lead edge area of the copy sheet and not to the remainder of the copy sheet, so as to improve the retention of the toner image to the body of the copy sheet. However, it will be appreciated that with a positive mechanical stripping system 10, that such a detacking system 28 is not required.

The moving imaging surface of the embodiment disclosed here is carried on a rotatably mounted, generally cylindrical drum. The curvature of the drum assists in the stripping of a copy sheet. However, it will be appreciated that with a positive mechanical stripping system as shown here that it is not essential to rely on a curvature, particularly on a high degree of such curvature, to provide stripping. Further, it will be appreciated that present stripping systems may also be utilized in copiers in which the photoreceptor is a moving belt flexibly assuming a configuration defined by its underlying support rollers or guides, rather than a cylindrical drum. Such organic or inorganic flexible photoreceptor belt systems also may have run-out problems, since stripping in such systems desirably occurs where the photoreceptor belt is curved and run over a supporting roller, and that supporting roller itself will normally have substantial run-out due to its eccentricity or its movement within its bearings relative to the copier frame.

With the present system, stripping may be initiated with the stripping edge contacting as little as one centimeter of the width of the copy sheet lead edge, particularly for liquid development systems where the image transfer does not leave electrostatic charges tending to reattach the stripped area of the copy sheet to the imaging surface. Thus, the dimension 21 may be, minimally, only slightly greater than this, but several centimeters could be appropriate.

The critical spacing of the stripping edge 22 above the photoreceptor may be provided in whole or in part by a skewed orientation of the stripper unit, or the edge 22, relative to the photoreceptor drum axis. The edge 22 could contact the drum at its outside end, and the skewed extension of the edge 22 over the curved-away imaging surface could provide the clearance.

If desired, the non-imaging edge area of the drum could be coated with a bearing or lubricating material surface. A toner-removing wiper or pad could be used in front of the bearing portion 16 to protect the bearing 18, if desired. For increased stability and bearing life, the dimensions of the bearing 18 could be substantially extended in the direction of movement of the imaging surface.

In conclusion, it may be seen that there has been described herein an improved copy sheet stripping system for stripping photoreceptors from an imaging surface with a simple, low cost mechanism and process which fully protects the utilized portion of the imaging surface. While the exemplary embodiment described herein is presently considered to be preferred, various other modifications or improvements will be apparent to those skilled in the art. The following claims are intended to cover all such variations and modifications as fall within the true spirit and scope of the invention.

What is claimed is:

1. In a copier in which images are formed on an imaging area of an imaging surface moving in a normal direction and transferred to a copy sheet, and in which said imaging surface also has a defined non-imaging edge area thereon adjacent to but outside of said imaging area, wherein the copy sheet is adhered to said imaging surface directly adjacent to, but not within, said edge area of said imaging surface, during said transfer, and wherein the adhering copy sheet is stripped from said imaging surface by a sheet stripping system engaging the lead edge thereof; the improvements in said sheet stripping system comprising:

a mechanical copy sheet stripping member mounted to said copier adjacent a desired stripping point along said moving imaging surface, said stripping member having a bearing portion with a bearing surface which directly slidably engages said imaging surface only in said edge area thereof, outside of said imaging area thereof, said bearing surface being the only portion of said stripping member engaging said imaging surface, said stripping member having resilient mounting means for movement of said stripping member together with movement of said imaging surface in a direction perpendicular to said normal movement direction directly controlled by said engagement of said bearing portion thereof with said edge area, said stripping member having an integral stripping finger portion with a sheet stripping edge thereon for mechanically engaging and stripping a copy sheet from said imaging area at a corner of the sheet adjacent said edge area, said stripping finger portion and said stripping edge thereon being mounted to, and supported by, said bearing portion for movement therewith, said stripping finger portion extending from said bearing portion in said edge area out over said imaging area of said imaging surface, continuously spaced therefrom, with said stripping edge maintained closely spaced from said imaging area by less than the thickness of the copy sheet by said continuous engagement of said bearing portion with said non-imaging edge area of said imaging surface.

2. The sheet stripping system of claim 1, wherein said stripping member, including said bearing portion and said stripping finger portion with said stripping edge, is a single monolithic unit.

3. The sheet stripping system of claim 1, wherein said stripping finger portion is a thick rigidly cantilevered integral extension of said bearing portion of said stripping member.

4. The sheet stripping system of claim 1, wherein said bearing surface underlies a major portion of said stripping member's dimensions transverse said normal direction of movement of said imaging surface to stably support said entire stripping member thereon.

5. The sheet stripping system of claim 1, wherein said bearing surface extends transversely of the direction of normal movement of said imaging surface by a distance greater than the distance by which said stripping finger portion extends from said bearing portion.

6. The sheet stripping system of claim 1, wherein said stripping edge of said stripping finger portion extends continuously from said edge area of said imaging surface out to the end of said stripping finger portion extending furthestmost into said imaging area.

7. The sheet stripping system of claim 6, wherein said sheet stripping edge is angularly disposed to the normal direction of movement of said imaging surface to provide a stripping edge angled relative to the lead edge of a copy sheet on said imaging surface.

8. The sheet stripping system of claim 1, wherein said spacing between said sheet stripping edge and said imaging surface is maintained less than 0.02 millimeters.

9. The sheet stripping system of claim 1, wherein said moving imaging surface is carried on a rotatably mounted generally cylindrical drum.

10. The sheet stripping system of claim 1, wherein said resilient mounting means are spring means forcibly springedly holding said bearing surface of said stripping member against said edge area of said imaging surface.

11. The sheet stripping system of claim 1, wherein said moving imaging surface is supported on a rotatably mounted generally cylindrical drum, said stripping finger portion is a thick rigidly cantilevered integral extension of said bearing portion of said stripping member, said bearing surface underlies a major portion of said stripping member's dimensions transverse said normal direction of movement of said imaging surface to stably support said entire stripping member thereon, said bearing surface extends transversely of the direction normal movement of said imaging surface by a distance greater than the distance by which said stripping finger portion extends from said bearing portion, and said stripping edge of said stripping finger portion extends continuously from said edge area of said imaging surface out to the end of said stripping finger portion extending furthestmost into said imaging area.

12. In a copying method in which images are formed on an imaging area of an imaging surface moving in a normal direction and transferred to a copy sheet, and in which said imaging surface also has a defined non-imaging edge area thereon adjacent to but outside of said imaging area, wherein the copy sheet is adhered to said imaging surface directly adjacent to, but not within, said edge area of said imaging surface, during said transfer, and wherein the adhering copy sheet is stripped from said imaging surface by a sheet stripping system engaging the lead edge thereof; the improvement in said sheet stripping comprising the steps of:

mounting a mechanical copy sheet stripping member to said copier adjacent a desired stripping point along said moving imaging surface, slidably engaging said imaging surface only in said edge area thereof, outside of said imaging area thereof with a bearing surface of said stripping member, said bearing surface being the only portion of said stripping member engaging said imaging surface, resiliently moving said stripping member together with movement of said imaging surface in a direction perpendicular said normal movement direction directly controlled by said engagement of said bearing surface with said edge area, mechanically engaging and stripping a copy sheet from said imaging area at a corner of the sheet adjacent said edge area with an integral stripping finger portion of said stripping member with a sheet stripping edge thereon, said stripping finger portion being cantilevered from said bearing surface out over said imaging area of said imaging surface, maintained continuously spaced therefrom, with said stripping edge maintained closely spaced from said imaging area by less than the thickness of the copy sheet by said continuous engagement of said bearing portion with said nonimaging edge area of said imaging surface.

13. The sheet stripping method of claim 12, wherein said bearing surface of said stripping member is forcibly springedly held against said edge area of said imaging surface.

* * * * *